US006827127B2

(12) United States Patent
Hauri

(10) Patent No.: US 6,827,127 B2
(45) Date of Patent: Dec. 7, 2004

(54) METHOD FOR THE BLASTING CALIBRATION OF A CHILL MOLD

(75) Inventor: Roland Hauri, Wettswill (CH)

(73) Assignee: KM Europa Metal AG, Osnabruck (DE)

( * ) Notice: Subject to any disclaimer, the term of this patent is extended or adjusted under 35 U.S.C. 154(b) by 102 days.

(21) Appl. No.: 10/305,928

(22) Filed: Nov. 27, 2002

(65) Prior Publication Data

US 2003/0106666 A1 Jun. 12, 2003

(30) Foreign Application Priority Data

Dec. 7, 2001 (DE) ..... 101 60 134

(51) Int. Cl.[7] ..... B22D 11/04; B22D 11/057
(52) U.S. Cl. ..... 164/459; 164/418
(58) Field of Search ..... 164/459, 418

(56) References Cited

U.S. PATENT DOCUMENTS 3,252,312 A * 5/1966 Maier ..... 72/56
3,743,692 A * 7/1973 Vinton et al. ..... 264/334
4,081,983 A * 4/1978 Shrum ..... 72/56
RE30,380 E * 8/1980 Shrum ..... 72/56
4,457,151 A * 7/1984 Mettler ..... 72/56
4,658,884 A * 4/1987 Euler et al. ..... 164/443
6,443,218 B1 * 9/2002 Hornschemeyer ..... 164/418

FOREIGN PATENT DOCUMENTS

GB 1 461 744 A * 1/1977 ..... B22C/9/00
GB 2 156 719 A * 10/1985 ..... B22D/11/04

* cited by examiner

*Primary Examiner*—Kiley Stoner
*Assistant Examiner*—Kevin P. Kerns
(74) *Attorney, Agent, or Firm*—Kenyon & Kenyon

(57) ABSTRACT

A method for blasting calibrating a chill mold (1) is provided. A calibrating mandrel is inserted into chill mold (1), thereafter an explosive material is placed on the outer surface (4) of chill mold (1) and is ignited. The inner side (3) of chill mold (1) is pressed against the calibrating mandrel by the explosive force, and brought to the setpoint measure. In the mold wall (2), chill mold (1) has bores (5) for cooling means and for measuring elements, which extend in the longitudinal direction (LR) of chill mold (1) and exit at the end faces (6, 7) of mold wall (2). Before the blasting calibration, the bores (5) are filled up with a free-flowing material and tightly closed. The free-flowing material is preferably an incompressible fluid and/or a bulk material.

19 Claims, 1 Drawing Sheet

METHOD FOR THE BLASTING CALIBRATION OF A CHILL MOLD

BACKGROUND OF THE INVENTION

1. Field of the Invention

The invention relates generally to a blasting calibration of a chill mold.

2. Description of Related Art

Among the related art are cooled ingot molds in which cooling channels are inserted into the tube walls, parallel to the longitudinal axis, which are able to have cooling means applied to them.

Furthermore chill tubes and also ingot molds are known which have vertical and/or horizontal channels in the mold walls into which temperature measuring elements can be inserted.

Because of the wear of a mold during casting, it is necessary to take it out of operation after a certain time in use, and to recalibrate it. For this purpose, each mold is first dechromed and then ground internally. Subsequently, a calibrating mandrel is placed into the mold, which in its external dimensions is equivalent to the internal dimensions of the new mold. After the insertion of the calibrating mandrel, the end faces of the mold are tightly closed, using plates.

Thereafter, the outer surface of the mold is covered with a suitable explosive, and this is detonated in a vessel filled with a fluid medium. Because of the blasting energy liberated, on the one side, and the counterpressure of the liquid medium on the other, the inner wall of the mold is pressed against the calibrating mandrel. In this manner, the mold gets back its exact inner contour required for its use in casting operation.

However, because of the wear of the mold during casting, and because of the internal grinding after deplating the chromium coat, it cannot be avoided in this method that material is removed, and as a result, the wall thickness of the mold is reduced during its repair, and consequently, the outer dimensions are reduced.

In order not to deform the bores in the mold in unacceptable fashion during the blasting calibration, no matter whether the bores are intended as cooling channels or receptacles for temperature measuring elements, filler pieces, preferably of high-grade steel, are inserted into the bores first, and are fitted exactly to the bores. Both the manufacture of these filler pieces and their mounting in the bores, as well as their dismounting, are connected with comparatively high time and manufacturing expenditure.

SUMMARY OF THE INVENTION

It is an object of the invention to provide a method for blasting calibrating molds, especially in the form of chill tubes and ingot molds, which is easier to control and relates to lower expenditure.

These and other objects of the invention are achieved by a method for the blasting calibration of a chill mold (1), especially in the form of a chill tube or an ingot mold. Bores (5), which are provided in the chill mold wall (2), are filled up. Thereafter, a calibrating mandrel is inserted into chill mold (1) and the outer surface (4) of the chill mold (1) is covered with an explosive material, whereupon the explosive material is ignited, and thereby the inner side (3) of the chill mold wall (2) is pressed against the calibrating mandrel. In accordance with the invention, the chill mold (1) is reinforced in its wall thickness, at least at its end regions, by building-up welding before the blasting calibration, then the bores (5) are filled up with a free-flowing material and tightly closed at the ends, whereupon the blasting calibration is carried out, and subsequently the end regions are processed to a new measure.

BRIEF DESCRIPTION OF THE DRAWINGS

The present invention will be described in greater detail with reference to the following drawings wherein.

DETAILED DESCRIPTION OF THE INVENTION

The invention is based on two measures which supplement each other in a combining way. One measure is the reinforcement of the end regions of the mold before the blasting calibration. This is done in particular by building-up welding, so that the losses in wall thickness due to the casting are compensated. In order not to deform the bores in the mold wall in an unacceptable fashion during the blasting calibration, they are now filled up before the blasting calibration with a free-flowing material and tightly closed at the end. By using a free-flowing material, one can, on a comparatively simple basis, also take into account different cross sections of the bores. Filler pieces that are specifically geared to the cross sections of the bores are no longer required. The expenditure in cost and the time-intensive effort drop out completely.

The advantages of the present invention are particularly noticeable when, as the mold, a chill tube or an ingot mold made of copper or a copper alloy are involved.

The bores can be filled up with an incompressible material, such as water.

However, the bores may also be filled up with a bulk material. In this case, the compressibility of the bulk material has a connection with its pore volume. The greater the compression of the bulk material and the finer the granulation, the lower is the pore volume of the bulk material and the greater is the strength [resistance to compression].

A further specific embodiment of the method according to the invention is that the bores are filled up with a mixture of an incompressible material and a bulk material.

If the bores are made to run the whole length of the tube wall and opening up into their end faces, this simplifies the manufacturing of the bores, and thus also the fabrication and recalibration of a mold.

The bores are preferably fabricated having a round cross section.

Figure 1:
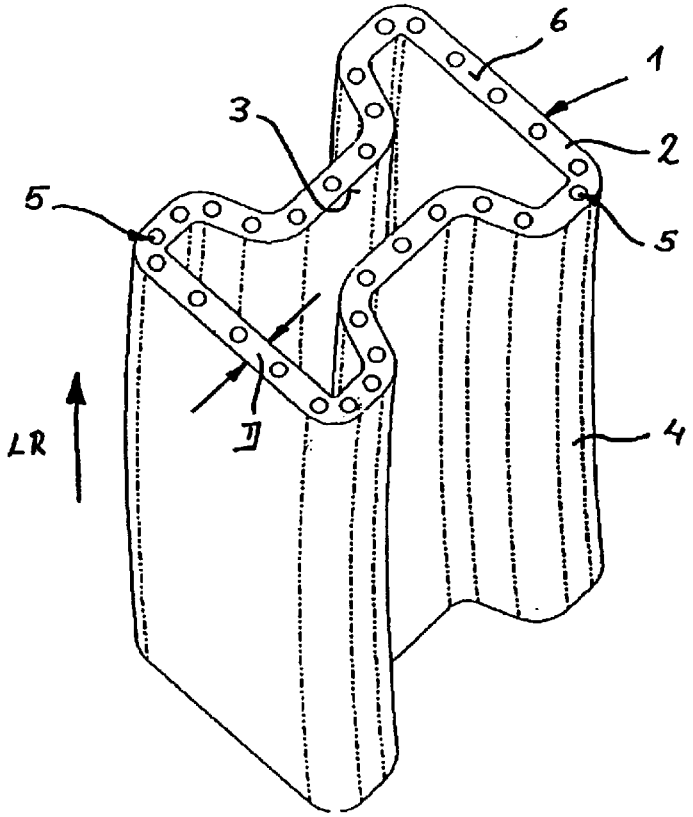
FIG. 1 is a perspective view of the upper section of a chill tube in accordance with the invention.
Figure 2:
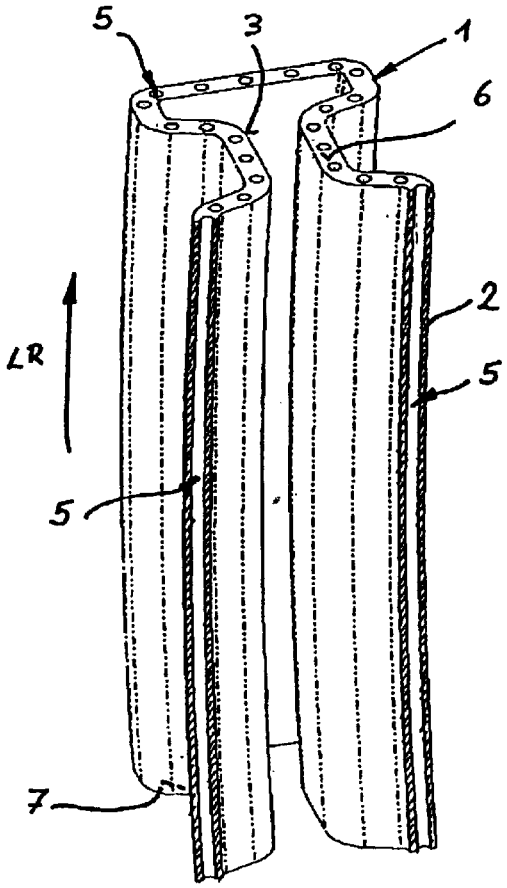
FIG. 2 is a changed perspective view, partially in section, of the tube mold of FIG. 1.

Chill tube 1, illustrated in FIGS. 1 and 2, has a double T-shaped cross section.

It has a tube wall 2 having a thickness D which remains uniform around the circumference. Consequently, the casting shape defined by inner wall 3 of tube mold 1 exists also at outer surface 4.

Bores 5 run in the longitudinal direction LR of chill tube 1 in tube wall 2. Bores 5 extend parallel to one another at a distance apart and exit from end faces 6, 7 of tube wall 2. They have a circular cross section.

What is claimed is:

1. A method for blasting calibration of a chill mold (1) having bores (5) in a chill mold wall (2), comprising: reinforcing the chill mold (1) in its wall thickness, at least at its end regions, by building-up welding; filling up the bores (5) with a free-flowing material and tightly closing them at their ends; inserting a calibrating mandrel into the chill mold (1); covering the outer surface (4) of the chill mold (1) with an explosive material; and subsequently igniting the explosive material, whereby the inner side (3) of the chill mold wall (2) is pressed against the calibrating mandrel.

2. The method according to claim 1, wherein the bores (5) are filled up with an incompressible material.

3. The method according to claim 1, wherein the bores (5) are filled up with a bulk material.

4. The method according to claim 1, wherein the bores (5) are filled up with a mixture of an incompressible material and a bulk material.

5. The method according to claim 1, wherein the bores (5) are fabricated over the entire length of the mold wall (2), opening out at its end faces (6, 7).

6. The method according to claim 2, wherein the bores (5) are fabricated over the entire length of the mold wall (2), opening out at its end faces (6, 7).

7. The method according to claim 3, wherein the bores (5) are fabricated over the entire length of the mold wall (2), opening out at its end faces (6, 7).

8. The method according to claim 4, wherein the bores (5) are fabricated over the entire length of the mold wall (2), opening out at its end faces (6, 7).

9. The method according to claim 1, wherein the bores (5) are fabricated having a round cross section.

10. The method according to claim 2, wherein the bores (5) are fabricated having a round cross section.

11. The method according to claim 3, wherein the bores (5) are fabricated having a round cross section.

12. The method according to claim 4, wherein the bores (5) are fabricated having a round cross section.

13. The method according to claim 5, wherein the bores (5) are fabricated having a round cross section.

14. The method according to claim 6, wherein the bores (5) are fabricated having a round cross section.

15. The method according to claim 7, wherein the bores (5) are fabricated having a round cross section.

16. The method according to claim 8, wherein the bores (5) are fabricated having a round cross section.

17. The method according to claim 1, further comprising processing the end regions of the chill mold (1) to a new measure after the inner side (3) is pressed against the calibrating mandrel.

18. The method according to claim 1, wherein the chill mold (1) is a chill tube.

19. The method according to claim 1, wherein the chill mold (1) is an ingot mold.

* * * * *